US005632496A

United States Patent [19]

Nelson

[11] Patent Number: 5,632,496

[45] Date of Patent: May 27, 1997

[54] CONVERTIBLE GOLF BAG SYSTEM

[76] Inventor: Alan F. Nelson, Rte. #3, Box 62, Ft. Dodge, Iowa 50501

[21] Appl. No.: 253,905

[22] Filed: Jun. 3, 1994

[51] Int. Cl.[6] ..... A63B 55/00; B62B 1/12

[52] U.S. Cl. ..... 280/30; 280/646; 280/DIG. 6; 206/315.3; 206/315.4; 206/315.5

[58] Field of Search ..... 280/30, 40, 645, 280/646, 654, 655, 47.18, 47.19; 206/315.3, 315.4, 315.5, 315.6, 315.7, 315.8; 248/96, 97, 98; 150/159, 160

[56] References Cited

U.S. PATENT DOCUMENTS

| | | | |
|---|---|---|---|
| 1,915,889 | 6/1933 | Johnsen | 206/315.3 |
| 2,602,676 | 7/1952 | Fieldhouse | 280/DIG. 6 |
| 2,760,782 | 8/1956 | Hartzell | 280/655 |
| 3,977,451 | 8/1976 | Duba | 150/159 |
| 4,350,194 | 9/1982 | Brown | 206/315.5 |
| 5,131,442 | 7/1992 | Bevier | 150/159 |
| 5,193,842 | 3/1993 | Fontenot | 280/645 |
| 5,215,194 | 6/1993 | Blanford et al. | 206/315.3 |
| 5,280,798 | 1/1994 | Helm | 206/315.4 |
| 5,351,983 | 10/1994 | Descalo | 280/646 |
| 5,390,717 | 2/1995 | Schenker et al. | 150/159 |
| 5,402,883 | 4/1995 | Shin | 206/315.3 |
| 5,435,546 | 7/1995 | Rao | 280/40 |
| 5,447,228 | 9/1995 | Hodgson, III | 206/315.3 |
| 5,454,576 | 10/1995 | Pitkanen | 280/645 |
| 5,470,095 | 11/1995 | Bridges | 280/646 |
| 5,472,084 | 12/1995 | Aliano, Jr. | 206/315.3 |
| 5,515,897 | 5/1996 | Fehan | 150/159 |

FOREIGN PATENT DOCUMENTS

| | | | |
|---|---|---|---|
| WO91/18650 | 12/1991 | WIPO | 206/315.3 |

*Primary Examiner*—Brian L. Johnson
*Assistant Examiner*—Min Yu
*Attorney, Agent, or Firm*—Gregory J. Nelson

[57] ABSTRACT

A convertible golf bag having a club-receiving carry bag detachably securable to a staff bag component with a portion of the exterior of the carry bag forming a part of the exterior of the assembled bag. When secured together, the resulting bag has the appearance and convenience of a large staff bag. The carry bag may be used separately as a light-weight bag. Various accessories including a pull cart, rain cover and personalized panels may be incorporated.

21 Claims, 5 Drawing Sheets

CONVERTIBLE GOLF BAG SYSTEM

BACKGROUND OF THE INVENTION

The present invention relates to a convertible golf bag and more particularly relates to a convertible golf bag system having a carry bag which may be used by itself or may be attached to another component converting the carry bag into a larger "staff" type golf bag.

Golfers customarily carry their clubs and other equipment including balls, clothing, shoes, and rain gear in a golf bag. There are various types and styles of golf bags available. The simplest bag is generally termed a "carry" bag which is a smaller, more compact bag of light weight material having limited storage capacity. This bag is preferred by golfers who walk the golf courses. The smaller size and light weight render it more convenient to carry.

Some golfers, particularly if they are transporting their golf equipment between golf courses as well as those who pay golf using a motorized cart, often prefer a larger bag which is termed a "staff" bag. Professional golfers generally also use the larger staff bags inasmuch as these bags provide greater surface for sponsor advertising. Also, golfers who have the benefit of a caddie to carry the clubs often prefer the staff bag.

Accordingly, there are times when a golfer prefers a smaller, lighter carry bag and there are other instances when the larger capacity of the staff bag is desired.

Accordingly, many golfers find it necessary to have several golf bags to accommodate their requirements. This is not only expensive but inconvenient as the use of multiple bags requires the golfer to transfer clubs and equipment between the bags depending on the preference of the golfer.

Accordingly, there exists a need in the area of golfing equipment for a convertible golf or combination bag which can be used as a light weight carry bag and which can be quickly and easily converted by the addition of storage compartments and pockets into a larger, more spacious staff bag.

Several combination or convertible golf bags can be found in the prior art. One of the earliest of these is shown in U.S. Pat. No. 2,256,521 which shows an all-purpose golf bag in which a smaller bag is slidably received within an outer bag.

U.S. Pat. No. 4,911,292 shows a combination golf bag having a rigid outer bag and a nonrigid inner bag. The upper portion of the inner bag is secured to the outer bag in a nested, substantially concentric position. When the bags are unsecured, the inner bag may be removed from the outer bag.

While the above are representative of the convertible bags in the prior art, certain disadvantages result from designs such as those described above. Convertible golf bags generally have not been accepted because they are often difficult or awkward to assemble and disassemble. Further, such bags typically each have separate straps and handles resulting in unnecessary duplication adding to the expense of the bag.

SUMMARY OF THE INVENTION

Accordingly, it is a primary object of the present invention to provide a convertible golf bag which incorporates a conventional carry bag and which carry bag may be easily secured to another component having additional compartments to convert the bag into a larger staff bag.

It is another object of the present invention to provide a side entry convertible bag which is simple and easily converted between a carry bag and a staff bag using a single, easily operated attachment mechanism.

It is another object of the present invention to provide a convertible bag which has various optional accessories including a foldable golf pull cart which in the stored position is contained within the storage compartment of one of the components.

It is still another object of the present invention to provide a convertible golf bag having various other accessories such as a rain cover, a tripod stand and garment pockets which may be optionally included.

It is still another object of the present invention to provide a golf bag having a panel insert which may be detachably secured to the bag and which panel insert may be personalized with the desired name, logo or other indicia.

It is still another object of the invention to provide a modular golf bag system, the compartments of which the user can acquire separately as desired.

Briefly, in accordance with the present invention, a convertible golf bag is provided which has as a first component a carry bag which is of conventional construction and which is adapted to receive the golfer's clubs and has one or more pockets for storage of equipment and accessories. The carry bag can be used separately as a light weight, convenient bag by the golfer. If the golfer desires to use a larger bag, the carry bag can be attached to the staff bag component. The staff bag component has a base in which the base or bottom of the carry bag is received. In addition, the staff bag component has a longitudinally extending generally U-shaped rigid sleeve which snugly engages the sides of the carry bag. The sleeve carries a large compartment extending substantially from the top to the bottom of the sleeve. The carry bag and the staff bag components are secured as a unit at a single attachment point such as by various means such as a latch, hook or a strap and buckle arrangement. When the carry bag and staff bag components are assembled, the bag has the overall appearance and convenience of a large staff bag. The carry bag is attached to the staff bag component by side entry insertion to eliminate lifting the bag.

In addition, an on-board golf pull cart may be attached to the sleeve of the staff bag. In the stored position, the golf cart is folded to the compact position with the wheels removed and the cart and wheels within the compartment of the staff bag. The compartment may be opened and the cart unfolded to a use position and the wheels attached to axles carried on the lower end of the arms of the golf cart. Other accessories may also be incorporated in the golf bag of the present invention. These include a rain cover which is attached to its own bag and deployed and reversed to form a cover. The cover is detachably secured to a support extending from the collar area at the end of the carry bag to support the cover out of contact with the clubs.

The staff bag component may be provided with an area defined by a flap for personalization. An insert panel may be detachably secured in the area secured by suitable fasteners such as loop and pile fasteners. The insert panel may be provided with personalization such as advertising, name of the golfer or other insignias.

BRIEF DESCRIPTION OF THE DRAWINGS

The above and other objects and advantages of the present invention will become apparent from the following description, claims and drawings in which:

DETAILED DESCRIPTION OF THE INVENTION

Figure 3:
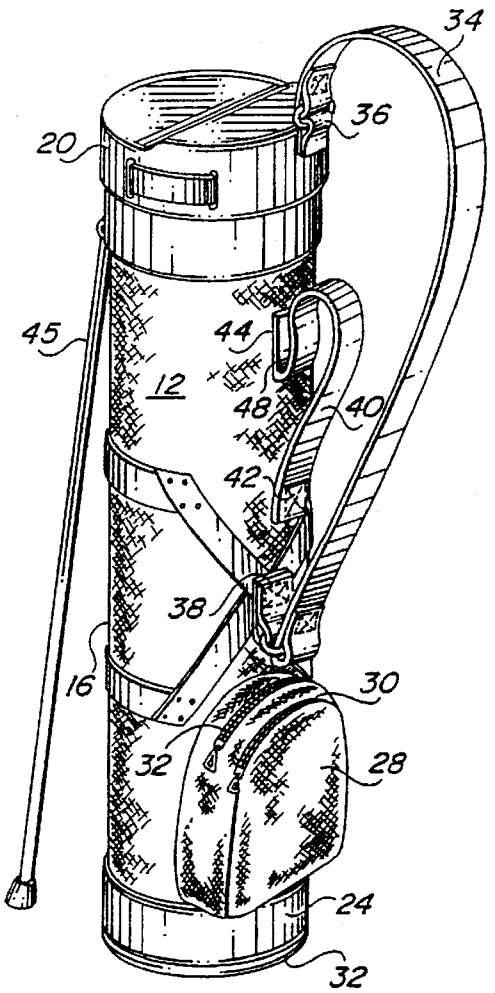
FIG. 3 is a side elevational view of the carry bag component of the convertible bag of the present invention.
Figure 2:
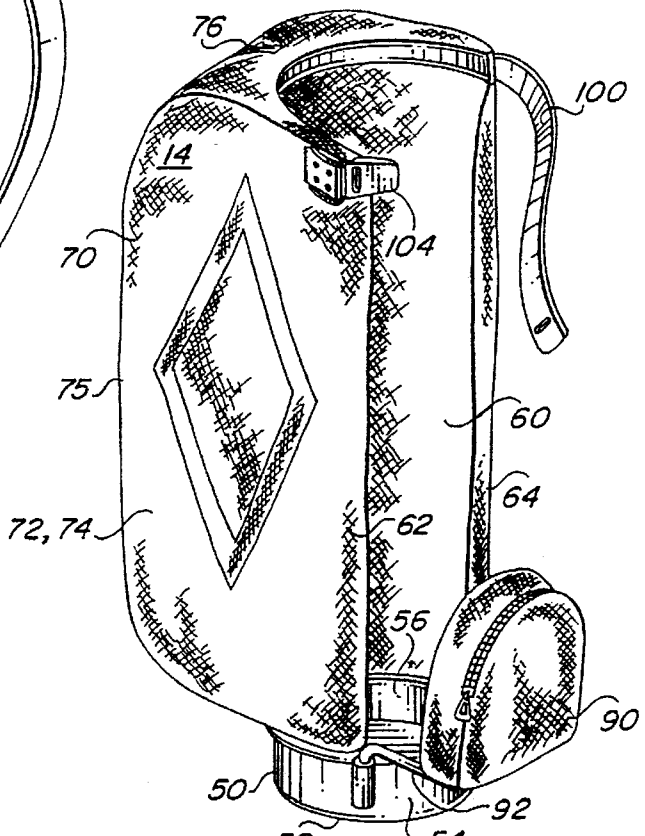
FIG. 2 is a side elevational view of the staff bag component of the convertible bag.
Figure 1:
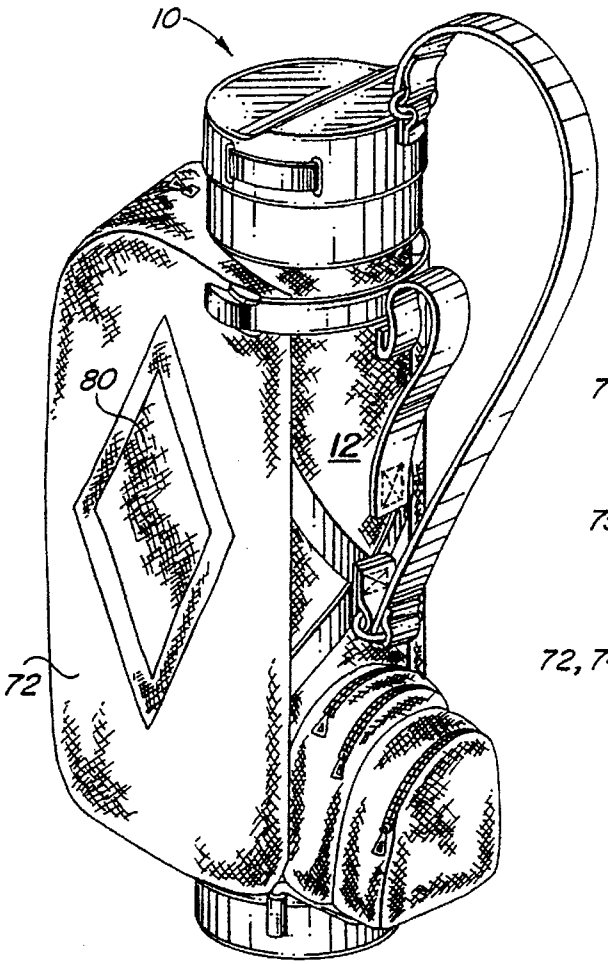
FIG. 1 is a side elevational view of the convertible bag of the present invention.

Turning now to the drawings, particularly FIGS. 1 to 3, the convertible bag of the present invention is generally designated by the numeral 10 and includes two principal components, a carry bag 12 and a staff bag component 14. The carry bag component 12 is best shown in FIG. 3 and is generally of conventional construction having an elongate tubular body 16 with a base 18 at the lower end and a collar 20 at the upper end. The body 16 may be of any suitable material such as cloth or synthetic fabric. The base 18 is generally formed of a rigid plastic material having a bottom plate 22 and a cylindrically extending lip or flange 24. The upper collar 20 is similarly conventional and may be fabricated from a rigid plastic material and may include one or more transversely extending dividers for maintaining the golf clubs in a separated position. A pocket 28 is affixed to the exterior of the body 16 having zipper 30 to provide access to the interior of the pocket. A smaller sub-pocket, not shown, is accessed by fastener or zipper 30. A carry strap 34 is secured at its upper end to a ring 36 secured to the collar 20. The opposite end of the carry strap 34 is secured to the bag at a location above pocket 28 at a ring 38. Typically the ends of the strap 34 are provided with snap hooks so that the carry strap may be detached from the bag at rings 36 and 38.

A carrying handle 40 is secured to the front side of the carry bag. The handle is a molded plastic component having a lower end 42 secured to the body of the bag. The upper end of the carrying handle 44 is secured to the bag at a location below the collar and is formed having a groove or undercut portion 48 upwardly disposed as shown in FIG. 3. The groove serves to receive or seat the attachment strap as will be more fully explained hereafter.

Thus, the carry bag 12 is generally of conventional construction and may serve as a light weight, compact bag for the storage of golf clubs within the body 16 and accessory items such as balls and other equipment in the pocket 28. Carry bag 12 has utility as a stand-alone bag for this purpose. The carry bag may include a conventional stand or tripod 45 which, when retracted, would nest against the staff component of the bag system.

However, if the golfer desires to add the benefit of a larger staff-type bag, the staff component 14 may be secured to the carry bag as shown in FIG. 1. The staff component 14 has a base 50 with a bottom plate 52 and a peripherally extending wall or flange 54. The base defines an internal receptacle 56 configured to snugly receive the exterior of the base of the carry bag. Preferably a rib or projection is provided in receptacle 56 to prevent relative rotation of the two bag components when assembled. A generally U-shaped sleeve 60 extends vertically from the base 50. The sleeve has opposite vertical edges 62 and 64 which are oppositely positioned and configured so as to snugly engage the opposite sides of the body 16 of the carry bag. The upper end of the sleeve terminates at a location immediately below the collar 20 of the carry bag when the carry bag is seated in the staff bag component.

Figure 4:
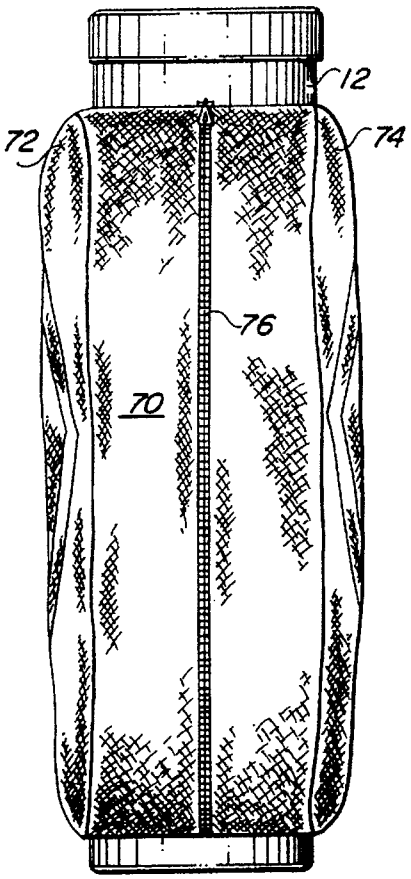
FIG. 4 is a rear view of the staff bag component.

As best seen in FIGS. 2 and 4, a large vertical compartment 70 is secured to the sleeve extending substantially the length of the sleeve and the length of the carry bag. The compartment 70 has opposite sides 72, 74 and rear surface 75. Surface 75 carries an elongated closure 76, shown as a zipper, extending from the top of the compartment to the bottom. The compartment may be fabricated from any suitable material such as a fabric or synthetic material. Appropriate insignia 80 may be placed on one or both of the surfaces 72 or 74 such as the name of the bag manufacturer, here indicated by the trademark "ProFound". Personalization of the insignia by use of an insert will be explained hereafter with reference to FIGS. 9 to 11.

In order to provide additional storage capacity, one or more additional pockets 90 are associated with the staff bag components. The pocket 90 is positioned at the bottom end of the staff bag component opposite the sleeve 50. The pocket is shown as being secured to the base by one or more L-shaped arms 92. As seen in FIG. 1, when the carry bag and staff bag components are assembled, the pocket 90 assumes a position tightly engaging the front of pocket 28 of the carry bag to provide additional storage capacity and to provide the multiple pocket appearance of a staff bag.

The attachment of the carry bag to the staff bag is accomplished by first seating the base of the carry bag in the base of the staff bag with the handle 40 and the carry strap 34 disposed outwardly as shown in FIGS. 1 and 3. Assembly is completed by securement of attachment means which are shown in FIGS. 1 and 2 as a strap 100 secured to the sleeve 60 at its upper end. In addition, a quick-release buckle 102 is secured to the opposite side of the sleeve near its upper end. The strap and buckle may be engaged by appropriate pivotal movement of lever 104 of the buckle. Thus, to secure the carry bag in place, strap 100 is extended about the body of the carry bag near its upper end with a portion of the edge of the strap engaging or being seated in groove 48. The free end of the strap is then passed through the buckle and lever 104 closed to tightly lock the bags together.

This method of attachment is simple, convenient and does not require multiple fastening operations and is basically a lateral insertion operation termed "side entry". Conversion between carry bag and staff bag does not require transfer of golf club or golf equipment. All of the golfer's basic golf equipment can be maintained in the carry bag portion of the convertible golf bag. The same carry strap and handle that are an integral part of the carry bag are also used as part of the assembled staff bag. The carry bag and the staff bag can be designed using materials and colors and designs to achieve a wide variety of cosmetic effects. Further, contrary to prior art convertible bags, a portion of the body of the carry bag, including the pockets, handle and strap, form a portion of the body of the combination bag.

The side entry insertion of the carry bag into the staff component has many advantages. Lifting the carry bag to a vertical position above the staff component is not required as it is with concentrically positioned combination bags. With the side entry feature, the carry bag can easily be removed from the staff bag when the bags are on a golf cart, in a locker or a car trunk, avoiding excessive lifting.

The large vertically extending compartment 14 of the staff component may be used for storage of various equipment and accessory items. If desired, compartment 14 may be used to store an integrally-mounted, collapsible pull cart. In the stored position, the pull cart and its components are fully contained within the large compartment. Referring to FIGS. 4 through 8, the pull cart is generally designated by the numeral 125 and has a frame assembly consisting of a vertical bar or rod 126 and a pair of spaced-apart arcuate members 127 and 128 which are secured to the arm and are also secured to the rigid sleeve 60 by a plurality of fasteners 130 such as wing nuts or other easy release fasteners. The entire cart assembly may be detached from the sleeve by removing fasteners 130.

Figure 6:
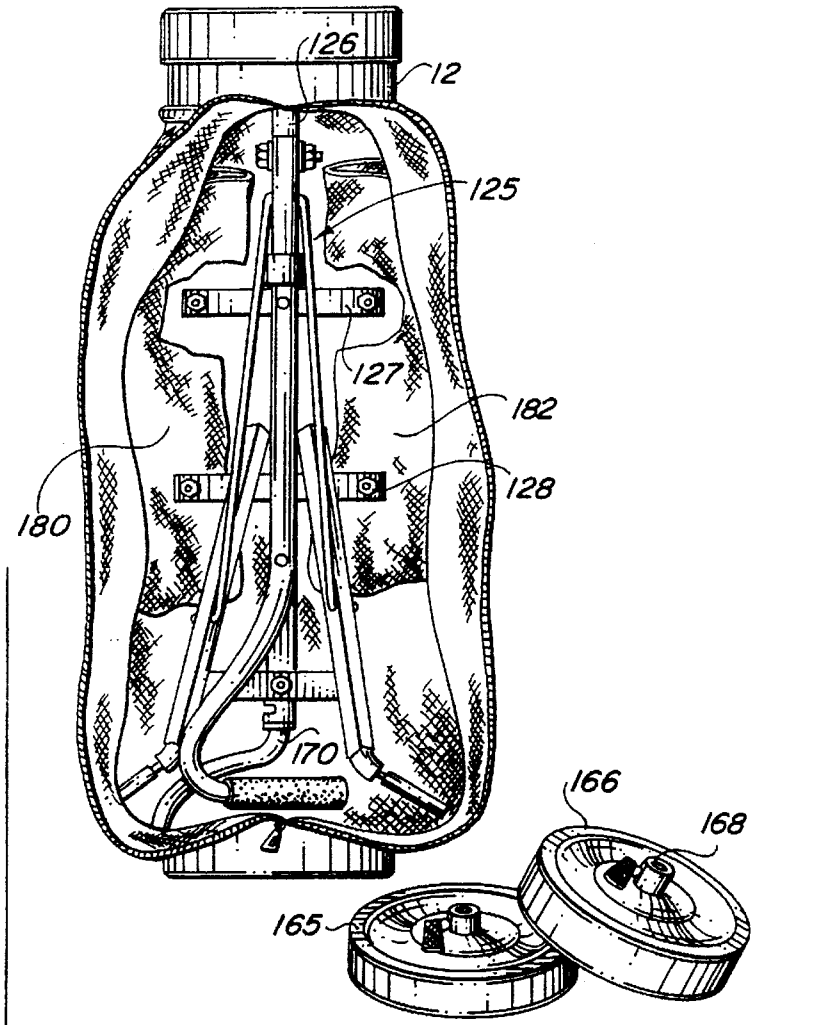
FIG. 6 is a view similar to FIG. 5 with the wheels removed in the stored position illustrating the components of the pull cart.
Figure 8:
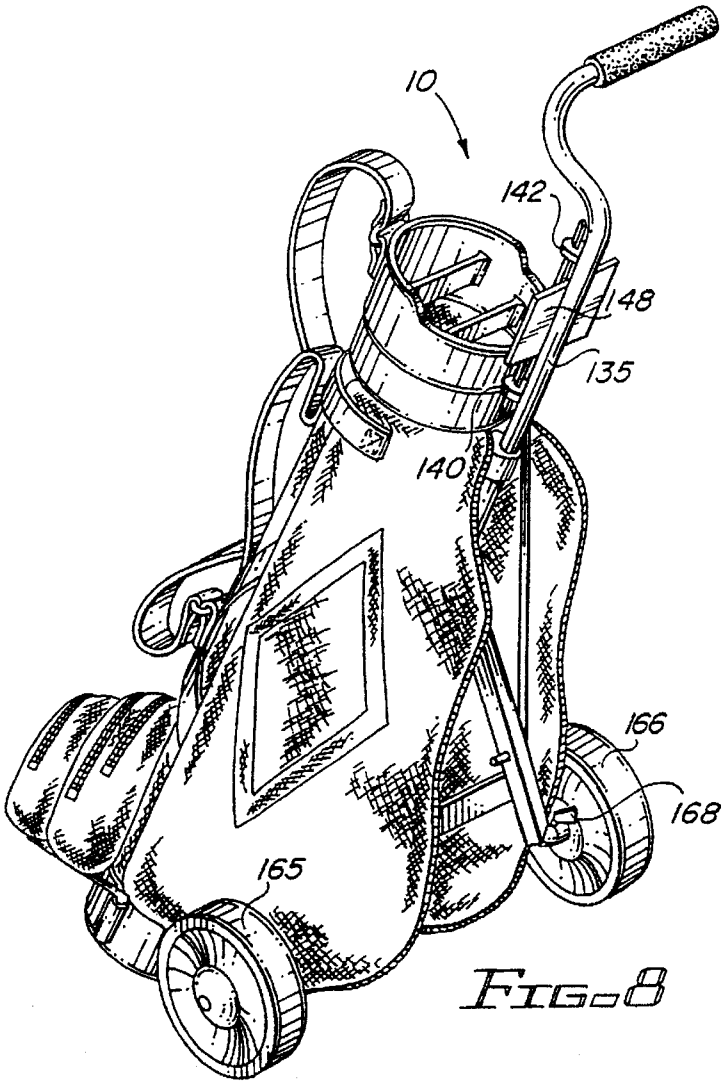
FIG. 8 is a perspective view illustrating the convertible golf bag of the present invention with the golf cart deployed and assembled.
Figure 7:
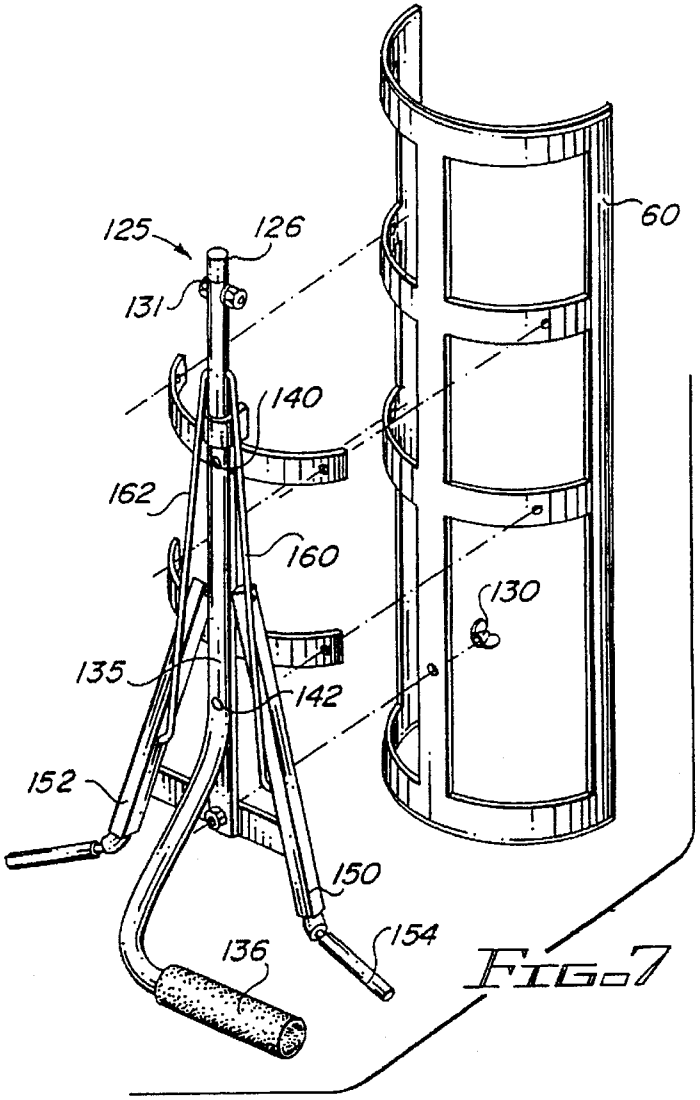
FIG. 7 is an exploded view showing the attachment of the pull cart to the rigid frame portion of the staff bag.

As indicated above, the foldable pull cart 125 is an optional accessory item which can be included as part of the staff bag component if desired by the user. A handle 135 is pivotally secured near the top of the frame member 126 at pivot and locking assembly 131. In the use position, the arm is extended and locked as shown in FIG. 8. The end of the arm 135 terminates at a padded grip handle 136. A pair of spaced-apart stub shafts 140 and 142 extend from the upper surface of the arm and in the stored position extend rearwardly as seen in FIGS. 6 and 7. "Rearwardly" as used herein refers to toward the rear surface 75 of the staff bag. In the position shown in FIG. 8, a holder 148 for a score card may be attached to the shaft 140, 142.

Axle support arms 150 and 152 are pivotally secured at their upper end to the frame member 126. The axle support arms 150 and 152 each terminate at a short stub axle 154. In the use position, the arms 152 and 154 are swung rearwardly to move them outwardly through opening 76 from their stored position. Struts 160 and 162 extend from the frame member 126 to arms 150 and 152, respectively, and serve to lock the axle support arms in the use position.

Figure 5:
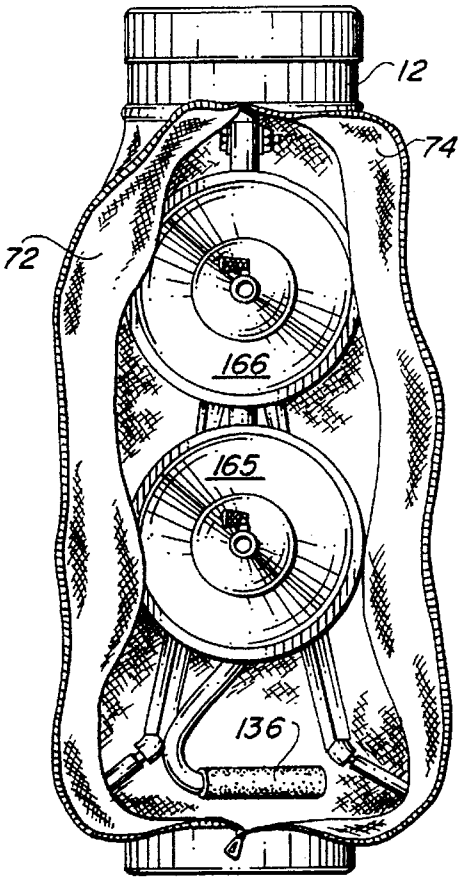
FIG. 5 is a view similar to FIG. 4 with the compartment opened illustrating the pull cart in a stored position.

In the stored position as shown in FIG. 5, the handle, struts and axle arms are foldably disposed toward the rear of the storage compartment. The wheels 165 and 166 are each provided with conventional quick-release mechanism 168. In the stored position, the wheels are secured to stub shafts 140, 142 maintained in the position shown in FIG. 5. When the cart is to be placed into use, the wheels are removed from the stub shafts 140, 142 and the cart unfolded as described above. Once unfolded, the wheels 165, 166 are attached to the axles at the lower end of the axle arms 150, 152 by their respective quick-release mechanisms 168. When the pull cart is in the use position as shown in FIG. 8, the bag can be conveniently manually transported by the golfer. Closure 76 may be partially closed. However, it will be appreciated that a portion of the closure must remain open to accommodate the protrusion of the cart.

As seen in FIG. 6, a tab or strap 170 may be provided to maintain the lower portion of the material of compartment 75 from engaging the ground when the pull cart is being used. The tab is connected to the frame to elevate the lower end of the compartment above the ground. As mentioned above, the staff bag and pull cart may be detached from the carry bag when the golfer wishes to use only the carry bag. Further, if the golfer wishes to having the added capacity of the storage compartment for storage of golf equipment, accessories and clothing, the golf cart, which is an optional item, may be detached at fasteners 130. Garment sleeves 180 and 182 are provided in compartment 14 for storage of items such as rain wear and sweaters.

Figure 9:
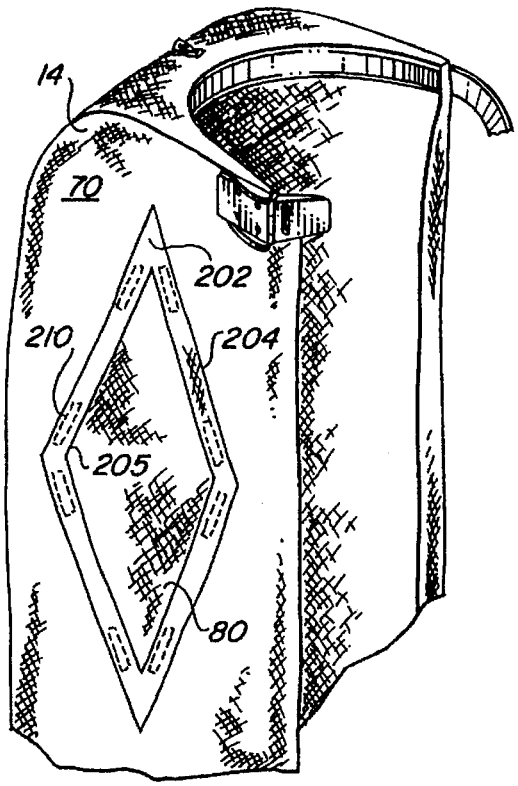
FIG. 9 is a side elevational view of the staff bag component of the invention.
Figure 10:
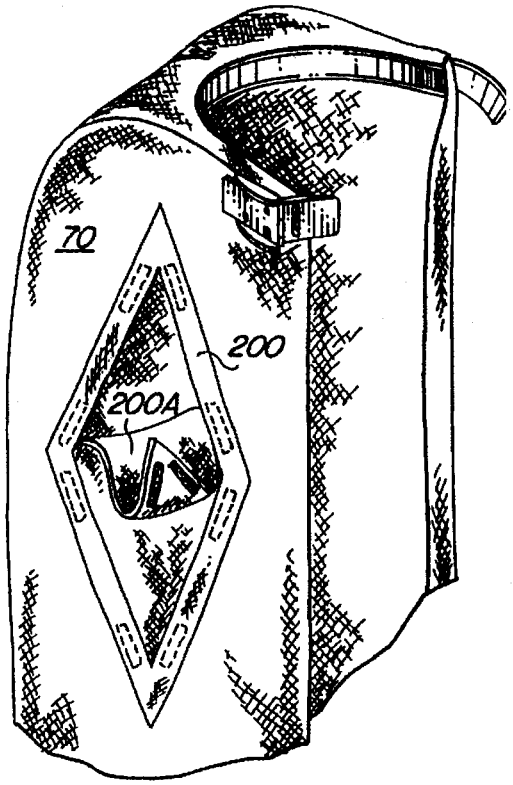
FIG. 10 is a view similar to FIG. 9 illustrating the insertion of the indicia-bearing insert to the bag.
Figure 11:
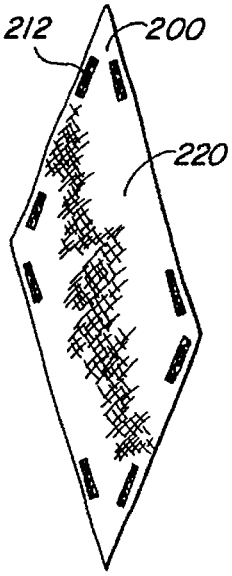
FIG. 11 is a plan view of a personalized replacement insert shown in FIGS. 9 and 10.

The present invention also facilitates personalization of golf bags. Many times, golfers prefer to have a particular insignia on the golf bag, such as the golfer's name, a particular golf manufacturer's logo, or identification of the golfer's school or organization. Personalization of bags has been difficult because this usually requires special order as embroidery or application of graphics to the bag normally must be done by the manufacturer prior to assembly of the bag. With the present bag, as shown in FIGS. 9 to 11, a surface of one of the bag components can be conveniently personalized by the insertion of insert 200. In FIGS. 9 and 10, the staff bag component of the bag 14 is shown which on surfaces 70 and 72 is provided with a peripherally extending cover flap 202 which is shown as being generally trapezoidal in shape but which can be any suitable shape such as oval, square, etc. The flap 202 is fabricated of suitable fabric material and has an outer edge 204 which is secured to the bag by any suitable method such as stitching, adhesive bonding or dielectric bonding. The inner edge 205 is free so that a continuous flap is established. The underside of the flap 202 is provided with fastener components 210 at spaced-apart intervals. The fastener components are preferably one portion of a loop and pile fastener such as the type sold under the trademark Velcro.

The insert 200 has a configuration generally conforming to the configuration of the cover 202. The outer surface of the insert 200 is provided with fastener components 212 which will matingly engage the portions 210 on the cover. Suitable indicia 220 are printed, sewn, painted, embroidered or otherwise applied to the panel. As shown in FIG. 11, the indicia consists of the name of the golfer. In FIG. 9 the indicia shown consists of the identification of a golf equipment manufacturer which would normally be applied to the bag when it is manufactured. If the golfer does not desire personalization of the bag, the golf equipment manufacturer's insignia 80 remains visible. However, if the golfer wishes to personalize the bag, the golfer would remove the manufacturer's insert 200A (FIG. 10) and apply the insert 200 as shown in FIG. 11 by inserting it beneath the free edges of the flap 202 and securing the fastener components 210 and 212. The advantage is that personalization does not have to be accomplished by special order of the entire bag. Rather the golfer, when purchasing the bag, would simply order an insert with the selected indicia which insert would be custom made and would be sent to the golfer by the manufacturer. The golfer can then easily insert the personalized insert in the manner shown in FIG. 10.

In many instances, golfers will either by choice or due to the vagaries of weather, find themselves playing in a shower or rain storm. In such a situation, most player's first concern is to protect the golf clubs to keep them dry. Rain covers or hoods of various types are provided for this purpose. As an alternative, many golfers carry towels with them which they will simply throw over the top of the golf bag.

Figure 12:
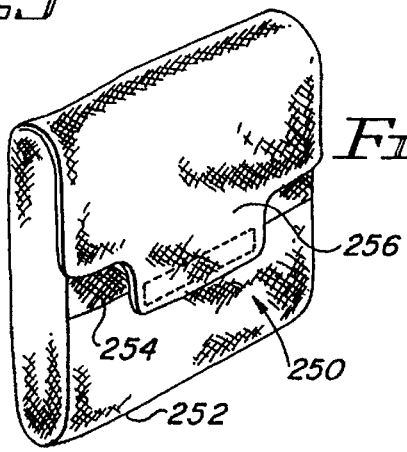
FIG. 12 is a perspective view of a pouch or bag containing a rain cover.
Figure 13:
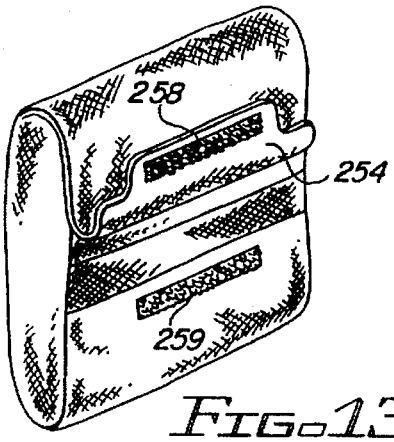
FIG. 13 is a view similar to FIG. 12 showing the first step in deploying the rain shield.

The present invention, as an accessory, provides a unique golf bag rain cover which has its own bag. As seen in FIG. 12, the rain cover 250 has an exterior pouch 252 defining an interior pocket having transversely extending opening 254. A flap 256 extends across the opening 254. The flap has one component of a loop and hook fastener 258 thereon and the pouch has a mating fastener section 259 thereon below the opening 254. When the rain cover is to be deployed, the fastener sections 258 and 259 are separated and the flap 256 lifted. An elongate sleeve 260 may then be extended from the opening 254. The sleeve 260 is secured to the inner side of the rear of the pouch. Sleeve 260 is fabricated from any suitable material such as synthetic waterproof fabric or a plastic film.

Figure 15:
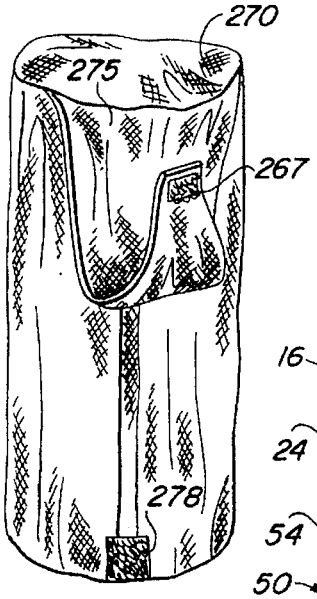
FIG. 15 is a view of the bag and shield after they have been inverted to complete the deployment of the rain shield.
Figure 16:
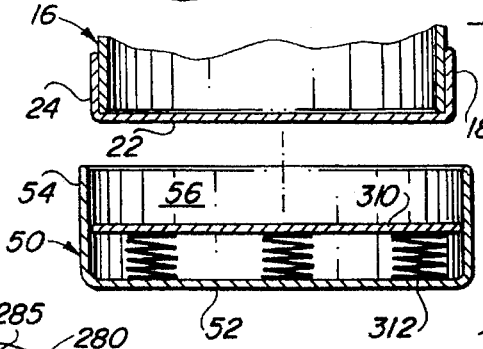
FIG. 16 is a perspective view of the upper end of the carry bag showing the rain shield support in a stored position.
Figure 16:
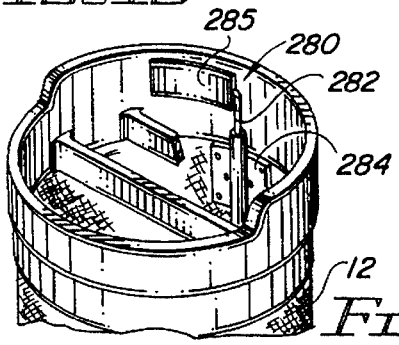
Figure 17:
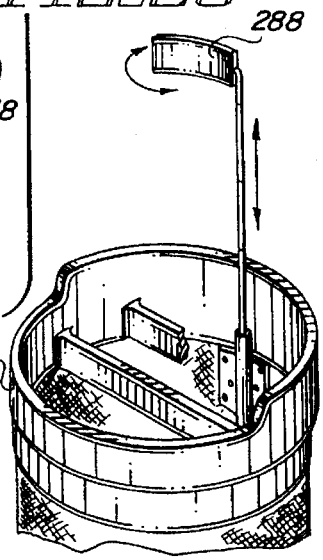
FIG. 17 is a view similar to FIG. 16 with the rain shield support in an extended position.

The rain shield is then reversed to the use position as shown in FIG. 15 so the pouch 252 now occupies a position within the sleeve. In this position, elongate flap 275 extends over the opening 262 being stitched along its upper edge to the sleeve. The flap is shown as being generally trapezoidal having a fastener member 276 at its lower end which cooperatively mates with fastener member 278 at the lower end of the opening or slit 262. The rain shield is secured at the upper end of the carry bag as shown in FIGS. 16 and 17. Preferably the carry bag has a mounting rod 280 which may be a solid rod or, as shown, is a telescopic rod 282 secured by brackets 284. The upper end of rod 280 carries attachment section 285 which when inserted through the open lower end of the sleeve will attach to one of the fastener sections 258, 259 on the pouch. Thus, the rod can be extended to the desired height above the clubs in the bag and the sleeve attached to the upper end of the rod so that it will drape down over the upper edge of the bag to protect the golf clubs and to keep moisture from entering into the interior of the golf bag. The sleeve is maintained out of contact with the clubs for easier club removal and insertion. When it is desired to remove a club, flap 275 may be detached and lifted upwardly and a club removed through longitudinally extending slot 262.

Figure 19:
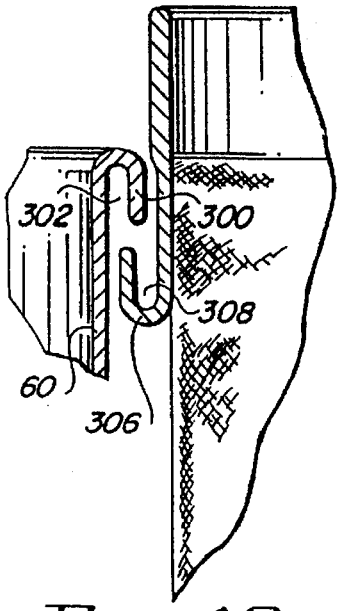
FIG. 19 is a sectional view showing the attachment system of FIG. 17.
Figure 14:
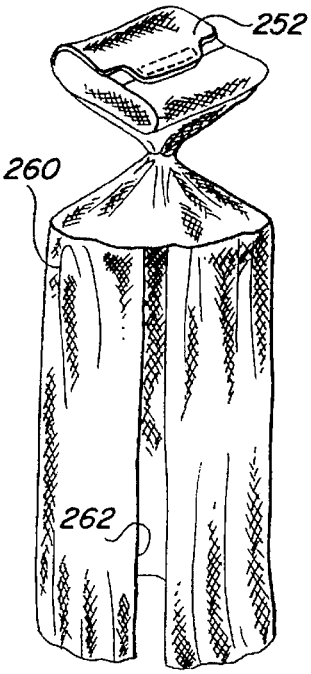
FIG. 14 is a perspective view illustrating the rain shield removed from the carrying bag.
Figure 18:
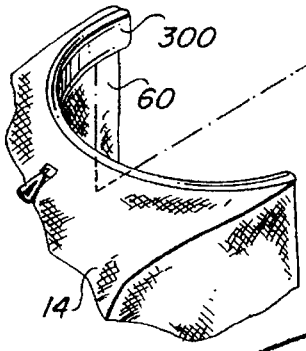
FIG. 18 is a perspective view of an alternate attachment system.
Figure 18:
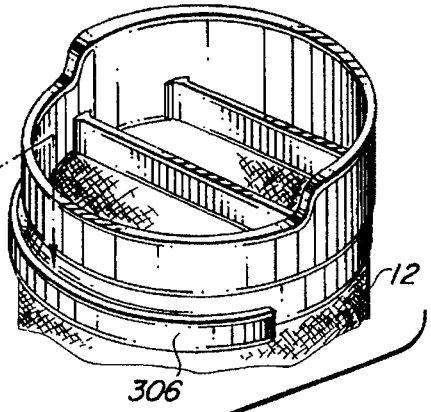
Figure 20:
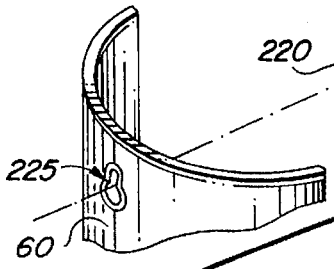
FIG. 20 is a sectional view showing the bases of the carry and staff bags.

FIGS. 18 to 20 show another system for attaching the staff and carry bag components 14 and 12. The upper end of the sleeve 60 of the staff bag is provided with a lip 300 which defines a downwardly opening hook 302. The carry bag has a flange 306 which defines an upwardly opening hook 308 which is engageable in hook 302 of the staff bag. Engagement is accomplished by placing the base 16 of the carry bag into the receptacle 56 of the base of the staff component as seen in FIG. 20. Applying downward manual force will depress plate 310 against springs 312 sufficiently to allow hooks 302 and 308 to engage. When the force is released, the spring 312 will maintain the bags in engagement at hooks 302 and 308.

Figure 21:
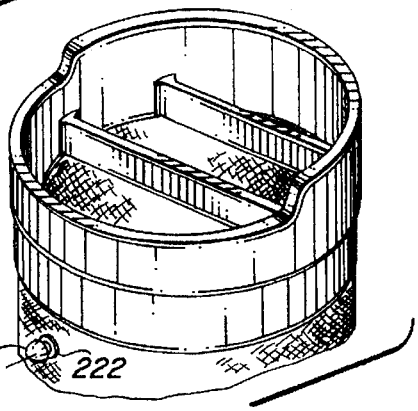
FIG. 21 is a partial perspective view of still another attachment system.

In FIG. 21 another attachment system is shown in which the carry bag 12 has a latch pin 220 with an annular groove 222 which is releasably receivable in inverted keyhole-shaped slot 225 in sleeve 60 of the staff bag component.

It will be noted that the same or similar components have been designated with the same numerals throughout this specification.

While the principles of the invention have been made clear in the illustrative embodiments set forth above, it will be obvious to those skilled in the art to make various modifications to the structure, arrangement, proportion, elements, materials and components used in the practice of the invention. To the extent that these various modifications do not depart from the spirit and scope of the appended claims, they are intended to be encompassed therein.

I claim:

1. A convertible golf bag comprising:

(a) a carry bag having a generally tubular body with an open upper end for receiving clubs and a bottom;

(b) a staff bag component having a base and an upstanding sleeve extending up from the base substantially the length of the carry bag, said sleeve having an open side with vertical edges to oppositely engage the body of the carry bag;

(c) at least one compartment on said staff bag component; and (d) cooperating first and second attachment means for selectively securing said staff bag to said carry bag, said first attachment means comprising rigid seat means extending in the area of the base of said staff bag component for receiving the bottom of said carry bag, said second attachment means connected to said staff bag component and securable to extend substantially around the upper end of said carry bag, whereby said carry bag may be positioned adjacent said staff bag component with said bottom engaging said first attachment means and whereby said bag components may be integrally joined by securing said second attachment means to form a combination bag with a portion of the body of the carry bag forming a part of the exterior of the combination bag and whereby said carry bag and staff bag components may be separated by disengaging said first and second attachment means.

2. The convertible golf bag of claim 1 wherein said carry bag has a handle and a carrying strap.

3. The convertible golf bag of claim 1 wherein said first attachment means includes a receptacle for receiving the bottom of the carry bag.

4. The convertible golf bag of claim 1 wherein said attachment means comprises a first collar means on said carry bag disposed near its upper end and second collar means on said sleeve engageable with said first collar means and biasing means associated with said receptacle for urging said first and second collar means into inter-engagement.

5. The convertible golf bag of claim 1 wherein said attachment means comprises an aperture in one of said sleeve and said carry bag and a projecting pin on said other of said sleeve and carry bag engageable in said aperture.

6. The convertible golf bag of claim 1 wherein said second attachment means comprises a belt attached to said staff bag component having an adjustable closure whereby said belt may be extended about a portion of said carry bag and secured.

7. The convertible golf bag of claim 1 wherein said staff bag includes a sleeve and wherein said compartment extends substantially the length of said sleeve.

8. The convertible golf bag of claim 7 further including a golf cart having wheels supported on a frame with handle and axle components foldable between a compact and a use-position detachably mounted to said sleeve and having a stored position within said compartment when in a folded condition.

9. The convertible golf bag of claim 8 wherein said golf cart includes a handle and axles pivotally mounted to a main frame component and said wheels are detachably securable to said axles.

10. The convertible golf bag of claim 9 wherein said wheels are retained in a stored position on stub shafts carried on said foldable handle.

11. The convertible golf bag of claim 1 further including a frame on said staff bag having a free edge and an insert generally corresponding to the shape of the frame and further including fastener means for securing the insert within said frame.

12. The convertible golf bag of claim 11 wherein said fastener means comprises loop and hook fabric fastener means.

13. The convertible golf bag of claim 1 further including a detachable rain cover defining a shroud having edges securable over the upper end of the carry bag.

14. The convertible golf bag of claim 9 wherein said detached wheels are retained in a stored position in said compartment by strap means.

15. The convertible golf bag of claim 13 wherein said rain cover includes a support member extending upwardly from the upper end of the carry bag and wherein said rain cover comprises a shroud member foldably received within a flexible pouch and integrally formed therewith.

16. The convertible golf bag of claim 15 wherein said shroud member is deployable from said pouch and reversible to position the pouch within the shroud and further including means for securing said shroud to said support.

17. The convertible golf bag of claim 1 further including a garment pocket within said compartment.

18. The convertible golf bag of claim 1 further including a first pocket on said carry bag and second pocket on said staff bag component supported from said base and whereby said first and second pockets are in engagement when said carry bag and said staff bag are integrally joined.

19. The convertible golf bag of claim 13 wherein said shroud includes an opening providing access to the golf clubs and further including a loose flap over said opening and securable at said opening.

20. The convertible golf bag of claim 8 further including retainer means for securing the lower end of the compartment above the ground when said golf cart is in an unfolded position.

21. The convertible golf bag of claim 1 wherein said carry bag includes a stand.

* * * * *